US005304090A

United States Patent [19]

Vanni

[11] Patent Number: 5,304,090

[45] Date of Patent: Apr. 19, 1994

[54] TOY HELICOPTER HAVING FORWARDLY INCLINED ROTOR SHAFT

[76] Inventor: Robert R. Vanni, 701 Tuxedo Ave., Brooklyn Heights, Ohio 44131

[21] Appl. No.: 9,248

[22] Filed: Jan. 19, 1993

[51] Int. Cl.[5] ..... A63H 27/127; A63H 27/00; A63H 27/26

[52] U.S. Cl. ..... 446/36; 446/45; 446/56

[58] Field of Search ..... 446/36, 37, 38, 39, 446/44, 45, 56, 62, 66, 68, 211, 429, 456, 460, 468; 244/63

[56] References Cited

U.S. PATENT DOCUMENTS

| | | | |
|---|---|---|---|
| 2,128,747 | 8/1938 | Johnson | 446/62 |
| 2,358,379 | 9/1944 | Butcher | 446/45 |
| 2,417,267 | 3/1947 | Porter | 446/62 |
| 3,390,480 | 7/1968 | Turner | 446/45 |
| 3,862,514 | 1/1975 | Ueda | 446/456 |
| 3,968,947 | 7/1976 | Schlegel et al. | 244/63 |
| 4,674,986 | 6/1987 | Ueda | 446/39 |
| 4,981,456 | 1/1991 | Sato et al. | 446/30 X |

FOREIGN PATENT DOCUMENTS

| | | | |
|---|---|---|---|
| 2332991 | 1/1974 | Fed. Rep. of Germany | 446/36 |
| 712196 | 9/1931 | France | 446/56 |
| 977904 | 4/1951 | France | 446/39 |

OTHER PUBLICATIONS

Flying Model Rockets, Estes Catalog, pp. 4, 38, 54, 1993.

*Primary Examiner*—David N. Muir
*Attorney, Agent, or Firm*—Albert E. Chrow

[57] ABSTRACT

A catapultable or rocket propelled toy helicopter (100,200) are provided that have foldable rotor blades (16 and 16') and a forwardly inclined rotor shaft surface (8) against which a rotor shaft (9) rests during flight that in combination with a balancing weight (28) enhance the spreading of rotor blades (16 and 16') at the apex of flight and the pitch and forward movement of the helicopter during flight thereafter.

12 Claims, 2 Drawing Sheets

TOY HELICOPTER HAVING FORWARDLY INCLINED ROTOR SHAFT

INTRODUCTION

This invention relates generally to a toy helicopter and more particularly to a toy helicopter that has a rotor that is rotatably carried by a pivotable rotor shaft and is operative to rotate at least one pair of diametrically opposed rotor blades that are adapted to fold into general alignment with the rotor shaft along the extent of the helicopter fuselage while the helicopter is being launched and then spread radially outwardly into a position generally transverse to the rotor shaft while the helicopter is in flight with the rotor shaft disposed forwardly from verticle at an acute angle predetermined to enhance forward movement of the helicopter during flight.

BACKGROUND OF THE INVENTION

The prior art is replete with toy constructions that involve devices that simulate various commercial heavier-than-air craft that involve a rotating blade and are commonly referred to as helicopters. This particular nomenclature however, should not be limiting for, by whatever name the structure is known, so long as it operates in a similar manner, it is to be considered the same.

This invention is an improvement over my invention described in U.S. Pat. No. 3,803,752, issued on Apr. 16, 1974, now expired and the disclosure of which is incorporated herein by reference. In the invention covered by my above referenced patent, the rotor shaft remained in a substantially upright position generally normal to the extent of the fuselage while in flight whereas in the present invention the rotor shaft is oriented forwardly at a predetermined acute angle from verticle to enhance forward movement during flight in addition to other improvements that will become apparent upon reading the description of various embodiments of the present invention provided herein.

SUMMARY OF THE INVENTION

Accordingly, it is an object of this invention to provide a toy helicopter that is operative to be launched into flight.

It is another object of this invention to provide a toy helicopter having a pivotable rotor shaft that assumes a position at an acute angle forwardly at a predetermined acute angle from verticle to enhance forward movement of the helicopter while in flight.

DESCRIPTION OF SOME PREFERRED EMBODIMENTS

Figure 1:
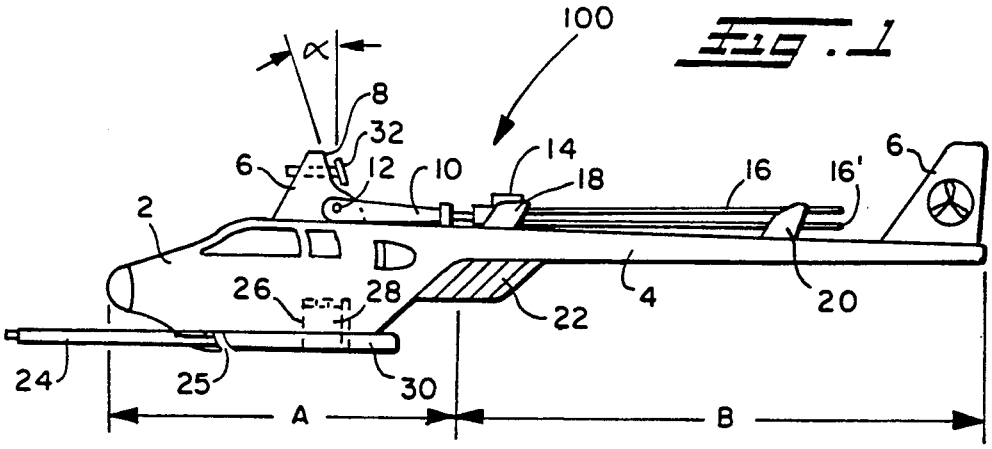
FIG. 1 is a side elevation view of a embodiment of the helicopter of the invention referenced by numeral 100 with the rotor blades in the launch position.
Figure 2:
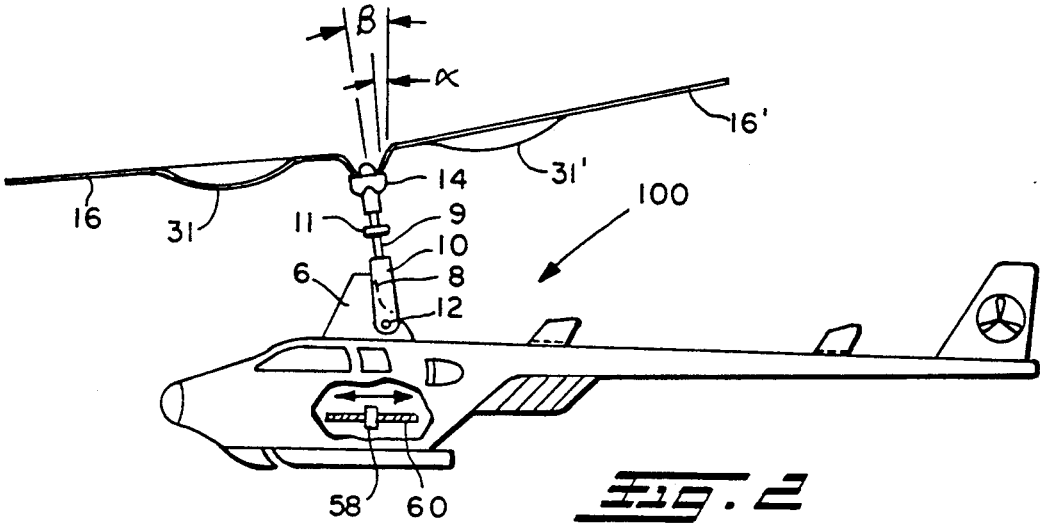
FIG. 2 is a side elevation view of helicopter 100 of FIG. 1 in the flight position with its rotor blade 16 and 16' spread radially apart.

Helicopter 100 of FIGS. 1 and 2 is a toy helicopter made from a suitable material such as light weight balsa wood or plastic material. Helicopter 100 has a fuselage having a front portion referenced by numeral "A" and a rear portion referenced by numeral "B". Front portion "A" is the cockpit area of helicopter 100 having decal windows and the like not referenced by numerals. Rear portion "B" is the elongate rear portion of helicopter 100 that includes the tail referenced by numeral 6 having a suitable decal simulating 6 side thrust propellers (not referenced by numerals).

Portions "A" and "B" have respective under sides and upper sides according to the conventional use of the terms when helicopter 100 is in the horizontal position relative ground shown in FIGS. 1 and 2.

Helicopter 100 of FIGS. 1 and 2 is provided with a groove or slot 25 on the underside of front portion "A" that is adapted to receive a resilient stretchable member such as a rubber band 24 therein that, upon release when in a stretched condition, is operative to catapult helicopter 100 into flight. Helicopter 100 preferably includes a hand grip on the underside such as referenced by numeral 22 to facilitate stretching the resilient stretchable member.

Figure 7:
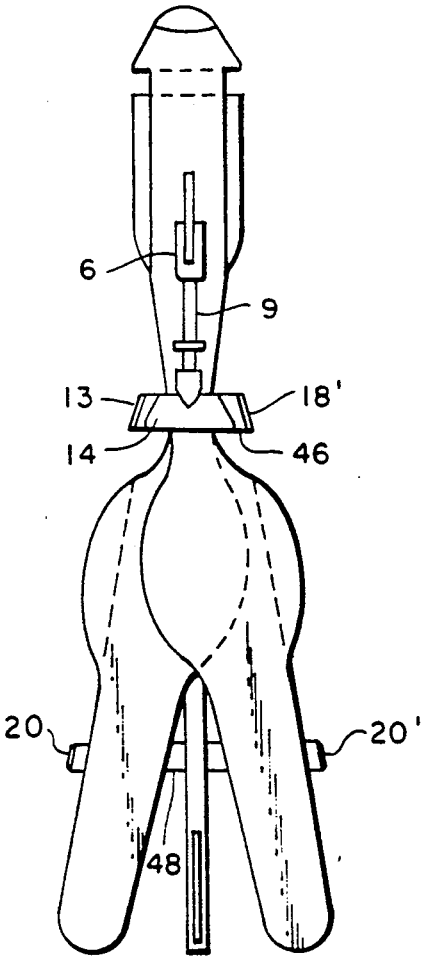
FIG. 7 is a top plan view of helicopter 100 of FIG. 1.

Helicopter 100 also preferably includes landing gear means on the underside of front portion "A" comprising at least one ground engaging member and more preferably a pair of spaced-apart landing pad type ground engaging members such as referenced by numerals 30 and 30' in FIG. 7.

The upper side of front portion "A" has a support member thereon referenced by numeral 6 that has rotor shaft support surface 8 that extends forwardly away from front portion "A" at an acute angle alpha ($\alpha$) from verticle.

Support member 8 may further include means for adjusting angle alpha such as by a threaded adjustment screw referenced by numeral 32 or other adjustment means such as an adjustable pin.

A rotor shaft support 10 is pivotally connected to support 6 by pivot 12 such that it is able to engage surface 8 while helicopter 100 is in flight.

Figure 5:
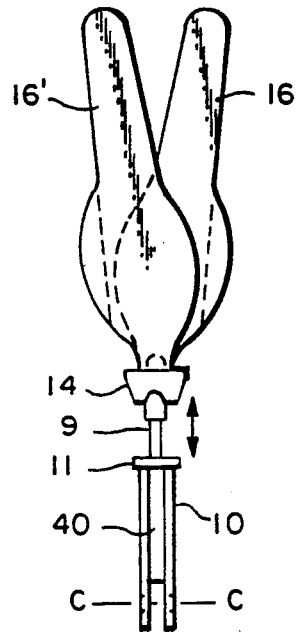
FIG. 5 is a front view of rotor 14 to which rotor blades 16 and 16' of helicopter 100 are secured.
Figure 6:
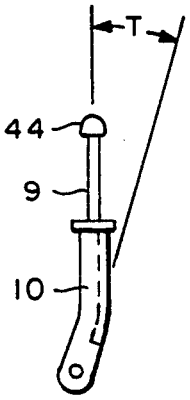
FIG. 6 is a side view of rotor shaft 9 that rotatably carries rotor 14' of FIG. 5.

As best seen in FIGS. 5, rotor shaft support 10 preferably has a channel-like configuration having a bottom or back surface 40 of which at least a portion engages surface 8 while helicopter 100 is in flight. The pivotable axis of rotor shaft support 10 (and of rotor shaft 9 which is preferably integral with rotor shaft support 10) is represented by line C—C in FIG. 5 and is generally transverse to the extent of the fuselage.

Rotor 14 is preferably a cupped rotor that is rotatably carried by rotor shaft 9 and is operative to slide axially in opposite directions therealong as shown by the arrows.

Figure 3:
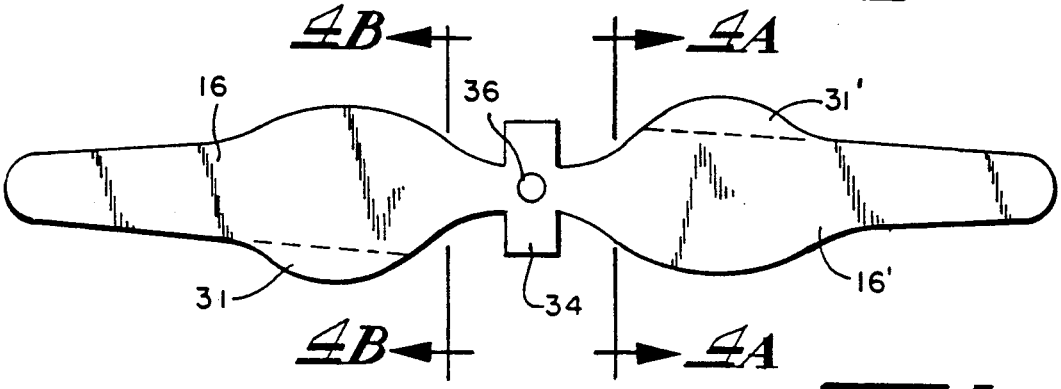
FIG. 3 is a top plan view of rotor blades 16 and 16' of helicopter 100 of FIG. 1.

Intermediate section 34 of a pair of diametrically opposed rotor blades 16 and 16' shown in FIG. 3 is adapted to fit into the cup-of rotor 14 and both are shaped (such as a rectangle) so that section 34 is rotarily driven by rotor 14 which rotates freely about rotor shaft 9. During assembly, opening 36 through section 34 of the rotor blade assembly is aligned with the opening through rotor 14 (not referenced) and rotor shaft 9 is then received therethrough afterwhich an end cap such as referenced by numeral 44 is secured to the end of shaft 9 for securement of rotor 14 and rotor blades 16 and 16' together.

Rotor blades 16 and 16' thus rotate in unison with rotor 14 about rotor shaft 9 and move axially therealong between end cap 44 and a stop such as a transverse shoulder 11 on support 10 shown in the Figures.

Rotor shaft support 10 and rotor shaft 9 may be aligned or shaft 9 may be bent forwardly at an acute angle tau ($\tau$) from the longitudinal axis of support member 10 at the location at which shaft 9 extends beyond the point of contact with rotor shaft support surface 8 such as shown in FIG. 2.

For purpose of simplicity, rotor shaft support 10 and rotor shaft 9 are considered to be one member such that, when aligned and engaging surface 8 shaft 9 is oriented forwardly from verticle at the same acute angle as surface 8, and, when shaft 9 itself is bent forwardly from the longitudinal axis of shaft support 10 by acute angle tau, shaft 9 is oriented forwardly from verticle at an acute angle beta ($\beta$) which is the sum of angles alpha and tau.

The acute angle between shaft 9 and verticle preferably ranges from about 5° to about 60° and more preferably from about 15° to about 45° and even more preferably from about 20° to about '°.

The forward inclination of rotor shaft 9 is operative to enhance forward movement of helicopter 100 while in flight with blades 16 and 16' tilted at an acute angle from horizontal as shown in FIG. 2 for they are generally transverse to rotor shaft 9 during flight.

In the launch position shown in FIG. 1, rotor blades 16 and 16' are folded generally parallel to each other and are in general alignment with the extent of the fuselage.

While in the launch position, rotor blades 16 and 16' are provided with a rest surface 48 to rest upon and rotor 14 is provided with a rest surface 46 to rest upon as shown in FIG. 7. Rest surfaces 46 and 48 are generally parallel to pivotal axis C—C of the pivot connection of rotor shaft support 10 to support 6.

Rest surface 46 is preferably provided with transverse members 18 and 18' at opposite ends thereof operative to contain rotor 14 therebetween and rest surface 48 is preferably provided with transverse members 20 and 20' at opposite ends thereof operative to contain rotor blades 16 and 16' therebetween.

Front portion "A" of helicopter 100 is provided with a balance weight such as weight 28 contained in chamber 26 in front position "A" as shown in FIG. 1. Weight 28 is positioned relative rotor shaft 9 in the forward inclined flight position such that the combination thereof is operative to control pivoting of the fuselage enhance forward movement of helicopter 100 during flight.

That balance weight may also be a positionable weight such as rotating weight 58 shown in FIG. 2 where position transverse to pivot axis C—C can be adjusted by rotating it axially along threaded rod 60 as shown by the arrows.

For a helicopter of the invention having an all over length of about nine inches of which about 3 inches is occupied by front portion "A" and the remainder by rear section "B", it has been found that balancing weight of about five ounces located about one half inch forward of pivot axis C—C is effective in cooperating with forwardly inclined shaft 9 to control pitch of the fuselage and enhance forward movement of the helicopter during flight.

Figure 4B:
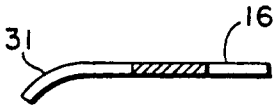
FIG. 4B is an end view of rotor blade 16 taken along view line 4B—4B of FIG. 3.
Figure 4A:
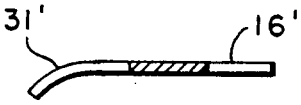
FIG. 4A is an end view of rotor blade 16' taken along view line 4A—4A in FIG. 3.

As shown in FIG. 3, rotor blades 16 and 16' may have respective contoured sections 31 and 31' that are preferably directed downwardly as shown in FIGS. 4A and 4B. Such contour sections are operative to slow rotation of rotor blades 16 and 16' and prevent helicopter 100 from spinning during flight.

Although only one set of generally diametrically opposed rotor blades are shown in the figures, it is to be understood that such is the preferred embodiment and that a plurality of equi-circumferentialy spaced blades may be employed.

Rotor blades 16 and 16' are made from flat thin flexible plastic such as a flexible poly propylene since they are required to automatically unfold and spread apart from each other until they are generally transverse to rotor shaft 9 during flight and then fold into general parallel alignment with each other when in the launch position. A flexible poly propylene having a thickness of about three to about 5 mils been found to provide the characteristics desired for rotor blades 16 and 16'. For a blade length of about 5 inches, it has been found that a width adjacent the center section 34 of about one half inch works effectively to promote foldability.

Figure 8:
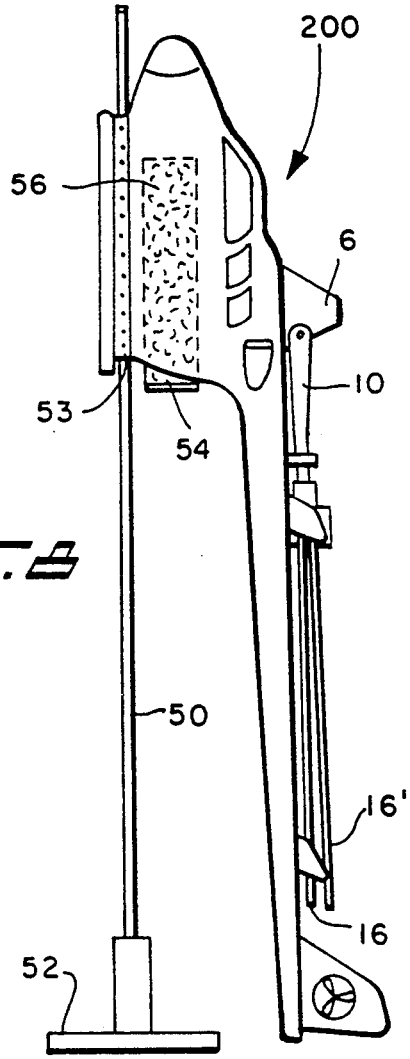
FIG. 8 is a side elevation view of another embodiment of the helicopter of the invention referenced by numeral 200 which is propelled into flight by ignited rocket fuel.

FIG. 8 illustrates another embodiment of the invention where helicopter 200 is adapted to be propelled by ignition of rocket fuel 56 contained in a rocket cartridge 54 inserted into a chamber 55 in front portion "A" having the rearwardly facing open end.

The underside of front portion "A" is provided with a guide tube 53 through which a guide rod 50 is slidably received that is secured to base 52 and operative to hold helicopter 200 in an upright launch position.

In FIG. 8, rotor blades 16 and 16' are in the folded launch position generally parallel to the extent of helicopter 200. Upon ignition or rocket fuel 56, helicopter 200 is propelled along guide rod 50 and into flight at the apex of which rotor blades 16 and 16' begin to rotate and spread apart under centrifigal force until generally transverse to the rotor shaft which is orientated forwardly at an acute angle from verticle to enhance forward movement during flight. The balancing weight assists the fuselage in dropping away from the rotor blades at the apex of flight to aid in their unfolding as well as control pitch of the fuselage to enhance forward movement of the helicopter during flight.

What is claimed is:

1. A toy helicopter including in combination a fuselage member having a front portion and a rear portion respectively having an upper side and an under side, means on the under side of one of said front and rear portions for launching the helicopter into flight, a balance weight secured to the under side of the front portion, a support member on the upper side of the front portion, said support member having a rotor shaft support surface extending forwardly away from the front portion at a predetermined acute angle from a vertical defined above the fuselage when the fuselage is horizontal, a rotor shaft pivotally connected to the support member at a pivotal connection such that a portion of the rotor shaft is able to engage the rotor shaft support surface, a rotor rotatably carried by the rotor shaft, said rotor having at least two diametrically opposed rotor blades connected thereto that are respectively adapted to spread from a folded launch position at which the rotor blades are in general parallel alignment with the rotor shaft to a flight position, said flight position commencing at an apex of flight after said helicopter is launched at which the rotor blades are in general transverse relationship with the rotor shaft, said rotor shaft operable to pivot about a pivotal axis of the pivotal connection from the launch position to the flight position at which the rotor shaft engages the rotor shaft surface, and said balance weight positioned along the under side of the front portion such that the combination of the acute angle of the rotor shaft and the balance weight position enhances forward movement of the helicopter during flight.

2. The helicopter of claim 1 wherein the fuselage rear portion has a rest surface for supporting the rotor in the launch position that is in general parallel alignment with the pivotal axis.

3. The helicopter of claim 1 or 2 wherein the fuselage rear portion has a rest surface for supporting the rotor blades in the launch position that is in general parallel relationship with the pivotal axis.

4. The helicopter of claim 2 wherein the rest surfaces includes cross member respectively disposed in substantial transverse relationship to the rest surface at opposite ends thereof for containing the rotor blades therebetween.

5. The helicopter of claim 3 wherein the rest surface includes a cross member respectfully disposed in substantial transverse relationship to the rest surface at opposite ends thereof for containing the rotor blades therebetween.

6. The helicopter of claim 1 wherein the rotor shaft is bent forwardly between the rotor and a portion thereof that engages the rotor shaft support surface at an inclination angle from vertical predetermined to enchance forward flight of the helicopter.

7. The helicopter of claim 1 wherein at least one of the rotor blades has a contoured portion operative to retard rotation of the rotor blades while the helicopter is in flight.

8. The helicopter of claim 1 including landing gear means comprising at least one ground engaging member on the under side of the fuselage front portion.

9. The helicopter of claim 1 wherein the means for launching the helicopter into flight comprises a slot on the under side of the fuselage front portion operative to receive a resilient stretchable member therein that, upon release while in a stretched condition, is operative to catapult the helicopter into flight.

10. The helicopter of claim 9 including at least one hand grip on one of the fuselage front and rear portions as a means for gripping to facilitate stretching of the resilient member.

11. The helicopter of claim 1 wherein fuselage front portion is provided with a chamber therein having a rearwardly facing open end, a guide tube is disposed in parallel relationship to the fuselage , and the means for launching the helicopter into flight comprises the combination of a launch rod adapted to be slidably received through the guide tube and hold the helicopter in an upright position and a rocket cartridge containing rocket fuel inserted into the chamber and the fuel upon ignition of which is operative to propell the helicopter upwardly along the launch rod and into flight.

12. The helicopter of claim 1 wherein the support member includes an adjustable member operative to adjust the acute angle between the rotor shaft and vertical.

* * * * *